United States Patent [19]

Sharp

[11] 4,016,522

[45] Apr. 5, 1977

[54] THERMAL SWITCH DEVICE AND METHOD OF MAKING

[75] Inventor: Larry Lee Sharp, Schaumburg, Ill.

[73] Assignee: Illinois Tool Works Inc., Chicago, Ill.

[22] Filed: Dec. 22, 1975

[21] Appl. No.: 642,971

[52] U.S. Cl. ..... 337/403; 337/404; 337/407; 29/623

[51] Int. Cl.[2] ..... H01H 37/76

[58] Field of Search ..... 337/401, 402, 403, 404, 337/405, 406, 407, 411, 414, 415, 417, 4, 5, 168; 29/623, 622; 169/42

[56] References Cited

UNITED STATES PATENTS

| | | | |
|---|---|---|---|
| 662,032 | 11/1900 | Sitts | 337/407 |
| 2,149,773 | 3/1939 | Huntley | 337/404 |
| 3,198,914 | 8/1965 | Baran | 337/414 |
| 3,519,972 | 7/1970 | Merrill | 337/407 |
| 3,956,725 | 5/1976 | Merrill et al. | 337/407 |

*Primary Examiner*—Harold Broome
*Attorney, Agent, or Firm*—Thomas W. Buckman; Robert W. Beart

[57] ABSTRACT

A thermal switch for automatically opening a circuit when the ambient temperature is increased to a predetermined level. A pair of conductor wires are arranged in side by side fashion with extremities extending in the same direction. A spring portion is included in at least one of the conductor wires to provide stored energy when the spring is biased into electrical contact with each other. A localized contact region is included in the conductor wire in the region below the spring portion but spaced upwardly from the associated extremities to create a lever arm. The extremities, contact region, lever arm and spring being encapsulated with a heat fusible material which biases the conductor wires into contact with each other and which is coated with a rigid insulating material to retain the conductor wires electrically insulated from each other except at the contact region. The heat fusible material holding the conductors into electrical contact until the temperature level reaches the level at which the fusible material flows thereby allowing the contacts to be separated due to the energy stored by the spring.

7 Claims, 8 Drawing Figures

Fig. 2
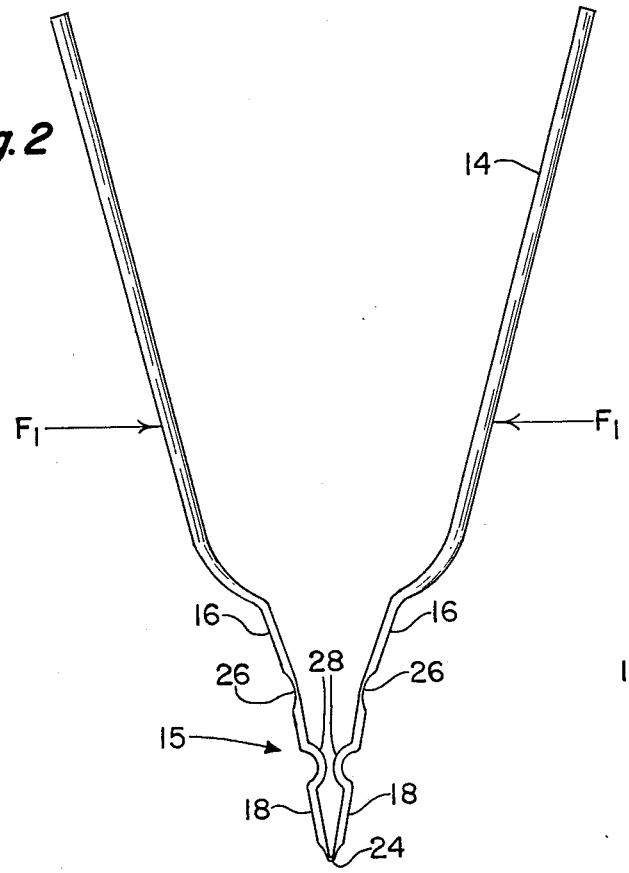
Fig. 3
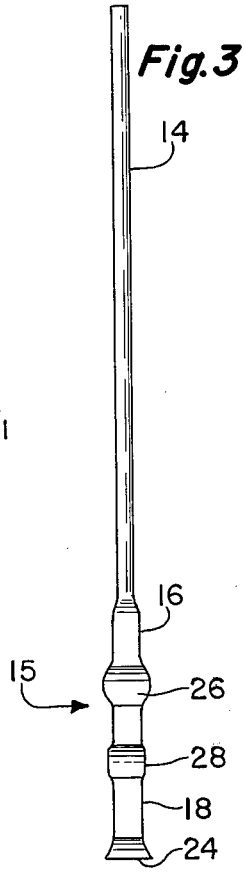
Fig. 1
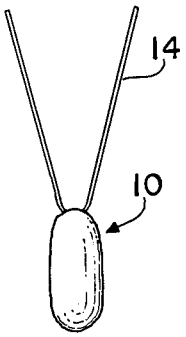
Fig. 4
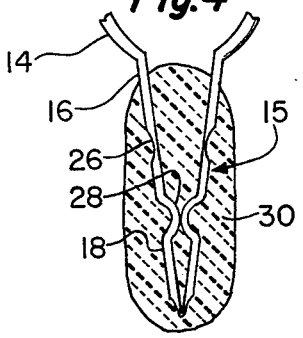
Fig. 5
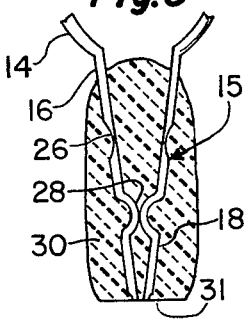
Fig. 6
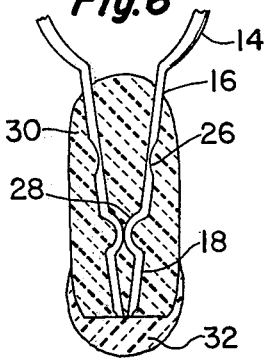
Fig. 7
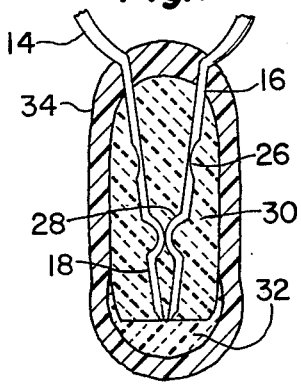
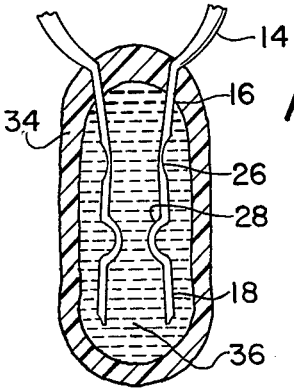
Fig. 8

THERMAL SWITCH DEVICE AND METHOD OF MAKING

BACKGROUND OF THE INVENTION

This invention relates generally to a switch which is responsive to an ambient temperature level.

The invention more particularly relates to an unresettable switch which will open a circuit when the ambient temperature around the circuit is increased to a predetermined level.

Switches of the type described have become necessary to protect various circuitry in devices such as appliances, etc., from the hazards of high temperatures generated therein. An increasing awareness of the hazards that present themselves as a result of a device which is capable of generating unchecked levels of heat emphasizes the importance of incorporating thermal switches in such devices. Not only destruction to the device but to the immediate surroundings could possibly be eliminated through the use of a switch which is capable of accurately sensing the increase in ambient temperature level to a predetermined amount and quickly and reliably opening the circuit to stop the flow of current therein.

Prior art devices of the type described are generally multipiece units with a conductive casing. The multipiece devices of the prior art are inherently costly to produce with a high level of quality control. One such prior art device utilizes a pair of coaxially arranged conductor wires, one of which is electrically connected to an outer conductive casing and the second of which is placed in releasable contact with the conductive casing through a thin washer member. The washer member is urged into contact with the second conductor wire through a spring and a thermal pellet. When a predetermined temperature level is reached, the thermal pellet liquifies, thus releasing the spring energy and allowing a secondary spring to force the washer out of contact with the second conductor wire. Such a device has approximately eight to ten different elements not including the conductor wires.

It is the primary object of the invention to provide a thermal switch device with a minimum of elements.

A further object of the invention is to provide a thermal switch device which is capable of quickly and reliably opening a circuit at a predetermined temperature level.

A still further object of the invention is to provide a thermal switch device which distributes spring loading energy over a relatively large surface area of heat fusible material.

Still a further object of the invention is to provide a thermal switch device which provides a lever arm construction to maximize the contact force while minimizing the unit reaction force on heat fusible encapsulating material.

The above and other objects and advantages are achieved by the present invention which basically provides for the encapsulation of contact regions of conductor wires, when spring loaded into contact with each other, with a heat fusible material, such as an appropriate organic mixture, followed by a coating or encapsulation of a rigid insulating material providing a structural and protective encasement for the circuitry while insulating the conductor wires from one another except at the contact region. Spring energy is provided in the system by forcing a section of at least one of the conductor wires inwardly against a bias. A localized contact region is provided below the spring bias region so that contact regions maybe forced together into electrical contact by a lateral compression force and dipped or encapsulated in a heat fusible material. The contact region is spaced upwardly from the terminal extremities of the conductor wires which are initially interconnected so that the contract regions serve as a fulcrum with stored energy distributed over a relatively large surface of heat fusible material by a lever arm. The terminal extremities are severed after the energy has been stored and the exposed extremities are coated with heat fusible material. The heat fusible material will be encapsulated with a rigid insulating material to structurally support the circuit. The encapsulated region will thus provide a closed circuit until the fusible material flows releasing the energy stored in the spring.

BRIEF DESCRIPTION OF THE DRAWINGS

FIG. 1 is an elevation of a completed thermal switch being drawn generally to the same scale and size as an actual switch constructed in accordance with the invention.

FIG. 2 is an elevational view of a conductive wire preform used in the construction of a preferred embodiment of the invention.

FIG. 3 is a side view of the preform shown in FIG. 2

FIG. 4 is a partial elevational view of the preform during a first step in the manufacture of a switch in accordance with the invention.

FIG. 5 is a view similar to that of FIG. 4 following a second step in the manufacture of a switch in accordance with the invention.

FIG. 6 is a partial elevational view of the preform during a third step in the manufacture of a device in accordance with the invention.

FIG. 7 is a cross-sectional view of the switching portion of the device of the invention in a loaded condition following its final manufacturing step.

FIG. 8 is a cross-sectional view of the device similar to that shown in FIG. 7 after the circuit has opened.

DESCRIPTION OF THE PREFERRED EMBODIMENT

The thermal switch device 10 shown in FIG. 1 and in more detail in FIG. 7 will first be described relative to the various steps to manufacture the preferred embodiment thereof and with particular reference to FIGS. 2–6.

A length of conductive wire is first formed into a generally U-shaped configuration, such as shown in FIG. 2, to include an open portion and a closd bight portion at opposing ends of the preform. The closed portion will be located in the switch section 15 and will be constructed so that the wire portions in the switch section are spaced from one another a distance less than the lead wire sections 14 at the open end of the preform. The switch sections 15 adjacent the bight portion 24 of the preform will generally consist of two subsections 16 and 18. The lower subsection 18 will include portions extending laterally outwardly from the upper subsection 16, such as resulting from being formed at an angle to one another and interconnected by a spring-like hinge 26. A localized contact region 28 is included on at least one of the opposing conductor wires in the switch section and is positioned intermediate the bight portion 24 of the conductor wire and the associated spring region 26. The cross-sectional configuration of the switch sections 15 are deformed from the generally circular cross-section in the lead portions 14 to a substantially flat configuration for a purpose to be described later herein.

The contact region 28 may be advantageously deformed from the switch section 15 as a protuberance or protuberances extending toward the opposing faces of the conductor wire.

The preform in the condition shown in FIG. 2 may be subjected to a compressive force F1, preferably in the upper region of the preform, exerted on the lead wire portions 14. This force brings the switch sections 15 together so that the opposing conductor wire portions are in physical electrical contact with each other at the contact point region. The force F1 will also be great enough to load the device by overcoming the spring bias of region 26 by bringing upper section 16 generally into alignment with the lower section 18. Since the contact regions 28 are spaced upwardly from the extremities of the preform, the contact region will serve as a fulcrum for this application of force. A slight preload is provided at contact regions 28 due to the force F1 and the retention of the ends of the conductor wires spaced downwardly from the fulcrum 28. In the position shown in FIG. 4, the bight portion 24, subsection 18, spring means 26 and portions of subsection 16 are dipped in a heat fusible material, such as an organic, having a predetermined melting or flowing temperature. The dipping is, of course, done while the organic is in a liquid state followed by cooling to room temperature, subsequent to the dipping, to produce an initial encapsulation 30, which will hold the contacts together in the position shown in FIG. 4.

With the preform in the retained position shown in FIG. 4, a second manufacturing step is performed thereon in order to sever the bight portion 24 so that the only remaining conductive path between opposing wire sections is at contact region 28. The severing may be accomplished by grinding the end of the preform removing the lowermost portions of the encapsulation 30 as at 31 in order to sever the bight portion 24. The resulting configuration of the preform is shown in FIG. 5.

With the spring loaded in the manner shown in FIG. 5, the exposed ends of the switch section are subjected to a second dip of heat fusible organic material to provide a complete insulating covering 32 of these exposed ends. The two dips of fusible organic material may, of course, be of exactly the same material and may become essentially homogeneous. Upon the cooling of the heat fusible material following this second dip, the circuit will be closed and the spring loaded in a preassembly shown in FIG. 6.

It should be noted that since the contact region 28 is spaced upwardly from the terminal extremity of subsection 18, a lever arm is included thereby serving to minimize the unit force which is necessary to establish firm electrical contact at the contact region. This configuration in addition to the flat surface of the wire in the switch section 15 substantially reduces the unit pressure on the organic material resulting from the energy loaded in the spring section. This, of course, becomes important since material such as the encapsulating heat fusible material will tend to be subjected to cold flow under the continuing forces exerted in the spring section.

Following the second dipping step, the switch section of the device and the heat fusible encapsulations 30 and 32 are totally and conformally coated with a layer of rigid insulating material 34. This coating 34 may be applied by a dipping process but convention casing techniques may be utilized as long as the casing intimately and conformally surrounds the heat fusible material and provides a structure for protecting the switch circuit while electrically insulating lead wires 14 at their point of entry into the switch section. Certain types of epoxy material are capable of functioning as the rigid insulating encasing material as long as the material sufficiently resists cold flow responsive to the energy stored in the spring sections. However, while the invention may be herein described as utilized epoxy as the encasing material, it should be understood that epoxy is only representative of a suitable material and the invention should not be restricted to a particular rigid insulating material.

The device shown in FIG. 7 is representative of the switch in its final loaded condition capable of transmitting current from one lead wire 14 to the other. When the environmental or ambient temperature reaches a predetermined level, the heat fusible organic 30 and 32 will flow or liquify, allowing the energy stored in the spring to be released, thus providing the open circuit structure shown in FIG. 8. The upper sections 16 will be locked in the epoxy so the lower region 18 and the contacts 28 will move laterally outwardly relative to the opposing wire sections and resume a substantially relaxed position as the energy is released in the spring. The reaction force of the spring system, during its loaded condition, will be distributed over a significant area or organic material since the switch region is flattened and the lever arm produced between the fulcrum point 28 and the extremity of the lower subsection 18 contributes to this distribution of forces within the flowable material.

Thus, it is apparent there has been provided in accordance with the invention a thermal switch device which fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim:

1. A thermal switch device comprising a pair of electrical conductor wire members in side by side relationship to each other and having free ends extending generally in the same direction, a localized contact region on the pair of conductor wire members providing an electrically conductive path between the wire members, the free extremities of the conductor wire members being adjacent the contact region but spaced downwardly therefrom, thereby forming a lever arm portion, at least one of said conductor wire members including a spring means to bias the opposing contact regions and adjoining lever arm portions of the pair of conductor wire members away from each other, the contact region, being located intermediate the spring means and the free extremity, providing a fulcrum for the lever arm thus serving to minimize the unit force necessary to establish firm electrical contact at the contact region, the free extremities, contact region and at least a portion of the spring means being encapsulated with a nonconductive heat fusible material with the conductor wires being forced toward each other and the contact regions forced into electrical contact with each other by the encapsulating material, the nonconductive heat fusible material as well as portions of the conductor wire adjacent the spring means extending out of the encapsulated material, being coated with a rigid insulating material to totally encapsulate the heat fusible material and spaced and insulate the extending conductor wire portions from each other, wherein the encapsulating heat fusible material acting on the contact regions and lever arm applies suitable pressure to maintain electrical contact between said two conductor wire members until said heat fusible material is subjected to a predetermined temperature level, at which level the fusible material flows, releasing the stored energy in the spring means to open the circuit.

2. The thermal switch device in accordance with claim 1, wherein the localized contact region includes a protuberance extending from at least one of the opposing surfaces of the pair of electrical conductor wire members providing a lateral spacing between the portions of the wire members directly adjacent the localized contact region when the wires are in electrical contact.

3. A method of forming a thermal switch device of the type including a pair of conductor wire members in side by side relationship and having free extremities extending generally in the same direction and adapted to spring apart, out of electrical contact with each other when a predetermined temperature level is attained, including the steps of forming an electrically conductive wire member to include at least one first region wherein a portion of the wire is spring biased out of the adjoining portion, said first region also including a localized contact region, bending the conductive wire member intermediate the extremities and adjacent the first region to provide a generally U-shaped preform with the free extremities extending generally in the same direction forming an open end portion of the preform, the lateral spacing between opposing wire sections at the open end being greater than the lateral spacing between opposing wire sections at the first region, applying a lateral compressive force to the open end of the preform to bring the localized contact region into electrical contact with a region on the opposing wire section with a bight portion interconnecting the opposing contact regions and to load energy in the first region by moving the upper portions of the wire inwardly against a spring bias surrounding the first region of the preform with a heat fusible material to retain the electrical contacting spring loaded configuration, severing the bight portion, coating the exposed ends of the severed bight portion with heat fusible material, coating the heat fusible material with nonconductive epoxy material so that the opposing wire sections are electrically insulated, except at the contact regions, thus encasing the first region to thereby form a spring loaded thermal switch.

4. The method in accordance with claim 3, wherein the first region is formed to include pairs of opposing contact regions spaced upwardly from the bight portion.

5. The method in accordance with claims 3, wherein the bight portion is severed by simultaneously cutting and removing a portion of the heat fusible material as well as removing the bight portion.

6. The method in accordance with claim 5, wherein the bight portion and heat fusible material is removed by grinding.

7. The method in accordance with claim 3, wherein the heat fusible material is applied by dipping the first region in liquified organic material and allowing the organic to solidify.

* * * * *